United States Patent [19]

Vanier et al.

[11] Patent Number: 4,738,950

[45] Date of Patent: Apr. 19, 1988

[54] AMINO-MODIFIED SILICONE SLIPPING LAYER FOR DYE-DONOR ELEMENT USED IN THERMAL DYE TRANSFER

[75] Inventors: Noel R. Vanier; Steven Evans, both of Rochester, N.Y.

[73] Assignee: Eastman Kodak Company, Rochester, N.Y.

[21] Appl. No.: 62,796

[22] Filed: Jun. 16, 1987

[51] Int. Cl.[4] ..... B41M 5/26

[52] U.S. Cl. ..... 503/227; 8/471; 427/146; 427/256; 428/195; 428/447; 428/913; 428/914; 430/945

[58] Field of Search ..... 8/470, 471; 427/146, 427/256; 428/195, 207, 447, 913, 914; 430/945; 503/227

[56] References Cited

FOREIGN PATENT DOCUMENTS 163145 12/1985 European Pat. Off. ..... 503/227

227087 10/1986 Japan ..... 503/227

*Primary Examiner*—Bruce H. Hess

*Attorney, Agent, or Firm*—Harold E. Cole

[57] ABSTRACT

A dye-donor element for thermal dye transfer comprising a support having on one side thereof a dye layer and on the other side a slipping layer comprising a lubricating material dispersed in a polymeric binder, the lubricating material comprising a linear or branched aminoalkyl-terminated poly(dialkyl, diaryl or alkylaryl siloxane) such as an aminopropyldimethyl-terminated polydimethylsiloxane or a T-structure polydimethylsiloxane with an aminoalkyl functionality at the branchpoint.

20 Claims, No Drawings

AMINO-MODIFIED SILICONE SLIPPING LAYER FOR DYE-DONOR ELEMENT USED IN THERMAL DYE TRANSFER

This invention relates to dye-donor elements used in thermal dye transfer, and more particularly to the use of a certain slipping layer, comprising a lubricating material dispersed in a polymeric binder, on the back side thereof to prevent various printing defects and tearing of the donor element during the printing operation. The lubricating material comprises a linear or branched aminoalkyl-terminated poly(dialkyl, diaryl or alkylaryl siloxane).

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head. This causes intermittent rather than continuous transport across the thermal head. The dye transferred thus does not appear as a uniform area, but rather as a series of alternating light and dark bands (chatter marks). Another defect called "smiles", which are crescent shaped low density areas, is produced in the receiving element by stretch-induced folds in the dye-donor. Another defect is produced in the receiving element when abraded or melted debris from the back of the dye-donor builds up on the thermal head and causes steaks parallel to the travel direction and extending over the entire image area. In extreme cases, sufficient friction is often created to tear the dye-donor element during printing. It would be desirable to eliminate such problems in order to have a commercially acceptable system.

European Patent Application No. 163,145 relates to dye-donor elements having a slipping layer on the back side thereof comprising a lubricant in a resin binder along with particulate material. A large list of lubricating materials is disclosed including various modified silicone oils such as an amino-modified silicone oil. No specific examples are disclosed, however. In addition, the slipping layer in that publication has a rough surface due to the presence of particulate material in order to prevent the dye-donor sheet from sticking to the thermal printing head. Such particulate material could have an abrading effect on the printing head, however, and is undesirable for that reason.

JP 61/227,087 relates to a heat-sensitive recording sheet containing a heat-sensitive layer on one side thereof consisting of an intramolecular siloxane bond-containing resin. The resin is formed by reacting a siloxane with other materials to form a polyurea resin, a polyurethane resin, a polyamide resin, etc. In all of those resins, however, there are no free amino groups remaining after reaction. As will be shown by comparative tests hereinafter, free or unblocked terminal amino groups are necessary on the polysiloxane in order to obtain good slipping properties and reduction of chatter and head build-up.

Accordingly, this invention relates to a dye-donor element for thermal dye transfer comprising a support having on one side thereof a dye layer and on the other side a slipping layer comprising a lubricating material dispersed in a polymeric binder, and wherein the lubricating material comprises a linear or branched aminoalkyl-terminated poly(dialkyl, diaryl or alkylaryl siloxane).

In a preferred embodiment of the invention, the polysiloxane is present in an amount of from about 0.0005 to about 0.05 g/m$^2$, representing approximately 0.1 to 10% of the binder weight.

Any polysiloxane can be employed in the slipping layer of the invention providing it contains units of a linear or branched aminoalkyl-terminated poly(dialkyl, diaryl or alkylaryl siloxane). In a preferred embodiment of the invention, the siloxane is an aminopropyldimethyl-terminated polydimethylsiloxane such as one having the formula:

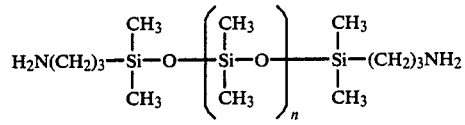

wherein n is from about 10 to about 2000. This material is supplied commercially from Petrarch Systems, Inc. Bartram Rd. Bristol, Pa. 19007 as PS513 ®.

In another preferred embodiment of the invention, the siloxane polymer is a T-structure polydimethylsiloxane with an aminoalkyl functionality at the branchpoint, such as one having the formula

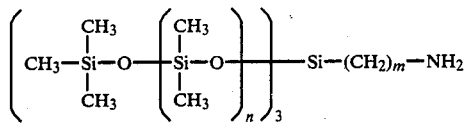

wherein m is from about 1 to about 10 and n is from about 10 to about 1000. This material is supplied commercially from Petrarch Systems, Inc. as PS054 ®.

Any polymeric binder can be used in the slipping layer of the invention provided it has the desired effect. In a preferred embodiment, thermoplastic binders are employed. Examples of such materials include, for example, poly(styrene-co-acrylonitrile) (70/30 wt. ratio); poly(vinyl alcohol-co-butyral) (available commercially as Butvar 76® by Dow Chemical Co.; poly(vinyl alcohol-co-acetal); poly(vinyl alcohol-co-benzal); polystyrene; poly(vinyl acetate); cellulose acetate butyrate; cellulose acetate; ethyl cellulose; bisphenol-A polycarbonate resins; cellulose triacetate; poly(methylmethacrylate); copolymers of methyl methacrylate; poly(styrene-co-butadiene); and a lightly branched ether modified poly(cyclohexylene-cyclohexanedicarboxylate):

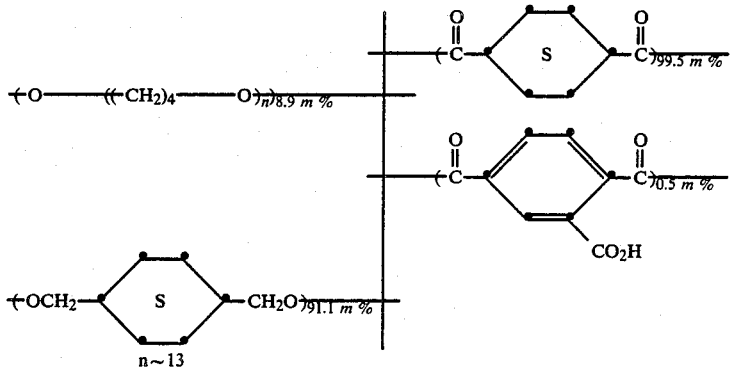

In a preferred embodiment of the invention, the thermoplastic binder is a styrene-acrylonitrile copolymer.

The amount of polymeric binder used in the slipping layer of the invention is not critical. In general the polymeric binder may be present in an amount of from about 0.1 to about 2 g/m$^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

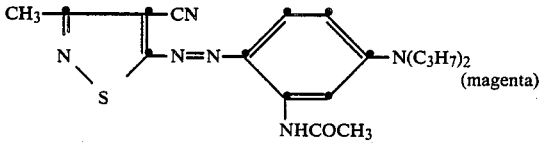

(magenta)

-continued

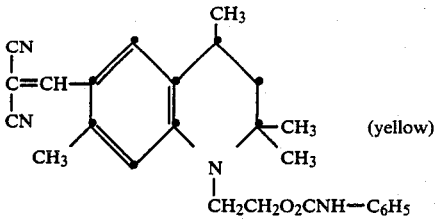

(yellow)

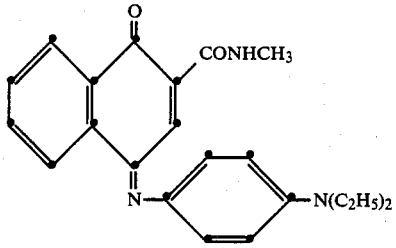

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether imides. The support generally has a thickness of from about 2 to about 30 μm. It may also be coated with a subbing layer, if desired.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Linear and "T-structure" Siloxanes

A dye-receiving element was prepared by coating 2.9 g/m$^2$ of Makrolon 5705® polycarbonate resin (Bayer A.G.), 1,4-didecoxy-2,5-dimethoxybenzene (0.32 g/m$^2$) and FC-431® (3M Corp.) surfactant (0.016 g/m$^2$) using a solvent mixture of methylene chloride and trichloroethylene on a titanium dioxide-containing 175 μm poly(ethylene terephthalate) support.

A cyan dye-donor element was prepared by coating on a 6 μm poly(ethylene terephthalate) support:

(1) a subbing layer of a titanium alkoxide (duPont Tyzor TBT®)(0.081 g/m$^2$) from a n-propyl acetate and n-butyl alcohol solvent mixture, and (2) a dye layer containing the cyan dye illustrated above (0.28 g/m$^2$) and duPont DLX-6000 Teflon® micropowder (0.016 g/m$^2$), in a cellulose acetate propionate (2.5% acetyl, 45% propionyl) binder (0.50 g/m$^2$) coated from a toluene, methanol and cyclopentanone solvent mixture.

On the back side of the dye-donor was coated:

(1) a subbing layer of Bostik 7650® polyester (Emhart Corp.) (0.11 g/m$^2$) coated from a toluene, 3-pentanone and 2-butanone solvent mixture, and (2) a slipping layer of the silicone identified below (0.011 or 0.032 g/m$^2$) in a poly(styrene-co-acrylonitrile) binder (70:30 wt. ratio) (0.54 g/m$^2$) coated from a toluene and 3-pentanone solvent mixture.

Control 1

A copolymer of a polyalkylene oxide and a methyl alkylsiloxane supplied commercially by BYK Chemie, USA, as BYK-320®.

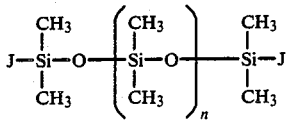

Control 2

J=—$(CH_2)_3$—$O_2C$—$C(CH_3)$=$CH_2$

Available commercially from Petrarch Systems, Inc.: PS-583 (viscosity: 2500–3500 ctsk)

Control 3

J=—$(CH_2)_3CO_2H$

Available commercially from Petrarch Systems, Inc.: PS-563 (viscosity: 2500–3500 ctsk)

Invention 1

J=—$(CH_2)_3NH_2$

Available commercially from Petrarch Systems, Inc.: PS-513 (viscosity: 2000 ctsk. ~2300 mw)

The following "T-structure" polydimethylsiloxanes were also evaluated:

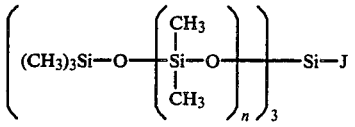

Control 4

J=—$(CH_2)_3$—$O_2C$—$C(CH_3)$=$CH_2$

Available commercially from Petrarch Systems, Inc.: PS-406 (viscosity: 80–100 ctsk)

Invention 2

J=aminoalkyl

Available commercially from Petrarch Systems, Inc.: PS-054 (viscosity: 1000 ctsk)

The dye side of each dye-donor element strip 1.25 inches (32 mm) wide was placed in contact with the dye image-receiving layer of the dye-receiver element of the same width. The assemblage was fastened in the jaws of a stepper motor driven pulling device. The assemblage was laid on top of a 0.55 inch (14 mm) diameter rubber roller and a TDK Thermal Head (No. L-133) was pressed with a force of 8.0 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated from 0 up to 8.3 msec to generate an "area test pattern" of given density. The voltage supplied to the print head was approximately 21 v representing approximately 1.5 watts/dot (12 mjoules/dot) for maximum power.

As each "area test pattern" of the given density was being generated, the force required for the pulling-device to draw the assemblage between the print-head and roller was measured using a Himmelstein Corp. 10010 Strain Gauge (10 lb. range) and 6-205 Conditioning Module).

The following results were obtained at various steps of the test pattern:

TABLE 1

| Silicone ($mg/m^2$) | Relative Force (lbs) Step 0 (D-min) (D~0.05) | Step 2 (D~0.2) | Step 8 (D-max) (D~2.3) | Comments Chatter During Passage | Head Build-up |
|---|---|---|---|---|---|
| Cont. 1 (11) | 4.4 | 5.3 | 4.2 | None | Very light |
| Cont. 1 (32) | 4.1 | 5.4 | 4.1 | Noticeable | Medium |
| Cont. 2 (11) | 4.6 | >8.4 | 4.5 | V. High | Heavy |
| Cont. 2 (32) | 4.4 | 5.0 | 4.1 | None | Very light |
| Cont. 3 (32) | 4.0 | 4.4 | 4.4 | Noticeable | Medium |
| Inv. 1 (11) | 3.5 | 3.8 | 3.5 | None | None |
| Inv. 1 (32) | 3.2 | 3.6 | 3.5 | None | Light |
| Cont. 4 (11) | 5.5 | 6.2 | 5.2 | Noticeable (Image defects produced) | Very light |
| Cont. 4 (32) | 4.7 | 6.2 | 4.5 | V. High (Image defects produced) | |
| Inv. 2 (11) | 4.3 | 4.7 | 4.1 | None | Medium |
| Inv. 2 (32) | 4.2 | 4.5 | 3.9 | None | V. light |

The above data shows that the slipping layer composition of the invention minimizes the force required for passage through the thermal head in comparison to various control materials. The chatter and head build-up of the control materials are believed to indicate potential longer term passage problems.

EXAMPLE 2

This example is similar to Example 1 but was run independently and provides additional controls to show the uniqueness of the aminoalkyl group of the siloxane to provide superior slipping performance.

Dye-receivers and dye-donors were prepared as in Example 1.

The following linear polydimethylsiloxanes were evaluated.

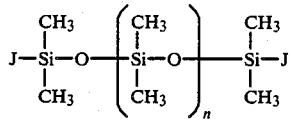

Control 5

J=—$CH_3$

Available commercially from Petrarch Systems, Inc.: PS-041 (viscosity: 50 ctsk)

Control 6

Same as Control 5 but at a viscosity of 10,000 ctsk Available commercially from Petrarch Systems, Inc.: PS-045

Control 7

Available commercially from Petrarch Systems, Inc.: PS-555

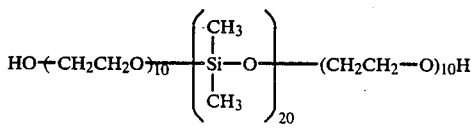

an ethylene-dimethylsiloxane-oxide A-B-A block copolymer)

Invention 1

See Example 1.

The same evaluation procedure was used as in Example 1 with the following results:

TABLE 2

| Silicone (mg/m²) | Relative Force (lbs) Step 0 (D-min) (D~0.05) | Step 2 (D~0.2) | Step 8 (D-max) (D~2.3) | Comments Chatter During Passage | Head Build-up |
|---|---|---|---|---|---|
| Cont. 5 (11) | 5.5 | >8.4 | 5.0 | High (Image defects produced) | Medium |
| Cont. 5 (32) | 4.8 | >8.4 | 4.3 | High | Medium |
| Cont. 6 (11) | 5.0 | >8.4 | 4.6 | High (Image defects produced) | Heavy |
| Cont. 6 (32) | 4.8 | >8.4 | 4.6 | High (Image defects produced) | Heavy |
| Cont. 7 (11) | 4.8 | >8.4 | 4.6 | High (Image defects produced) | Heavy |
| Cont. 7 (32) | 3.9 | 5.5 | 4.3 | High (Image defects produced) | Medium |
| Inv. 1 (11) | 3.9 | 4.4 | 4.1 | None | None |
| Inv. 1 (32) | 3.9 | 4.2 | 3.8 | None | V. Light |

The above data again shows that the slipping layer composition of the invention minimizes the force required for passage through the thermal head in comparison to various control materials. The chatter and head build-up of the control materials are believed to indicate potential longer term passage problems.

EXAMPLE 3

Comparative Test—Blocked v. Free Amino Siloxanes

Two amino-blocked silicone polymers, Controls 8 and 9 differing only in the molecular weight of the polysiloxane diamine were prepared as described below.

Synthesis of a Polydimethylsiloxane-urea Resin—Control 8

This procedure is adapted from Example 2 of JP 61/227,087 (Dainichiseika Color Chem.) except that dry tetrahydrofuran was used as a solvent instead of a mixture of dimethylformamide and butanone in order to facilitate product isolation. The polysiloxane diamine used was General Electric 218-1036® which had an average molecular weight of approximately 6800 instead of 1000 as disclosed in the application example.

A 500 mL round bottomed flask fitted with a condenser, magnetic stir bar and gas inlet tube was charged with 20.4 g (approximately 3 mmole) of GE 218-1036® polysiloxane diamine and 100 mL tetrahydrofuran (dried over molecular sieves). The flask was flushed with nitrogen and a solution of 0.8 g (3.4 mmole) of duPont Hylene-W® (4,4'-methylene bis-cyclohexylisocyanate) in 5 mL tetrahydrofuran was added. The reaction was heated at reflux for 2 hours under a nitrogen atmosphere and the solvent removed in vacuo to yield a colorless rubbery residue, soluble in tetrahydrofuran and butanone.

Synthesis of a Second Polydimethylsiloxane-urea Resin—Control 9

This material was prepared exactly as in the above example except that Petrarch Systems-PS-510® (a polysiloxane diamine with average molecular weight of approximately 3000) was used.

Thus a resin was prepared from 18.0 g (6.0 mmole) PS510® and 1.6 g (6.8 mmole) duPont Hylene-W® (4,4'-methylene bis-cyclohexylisocyanate). A clear, rubbery resin was obtained, soluble in tetrahydrofuran and butanone.

A cyan dye-donor element was prepared by coating on a 6 μm poly(ethylene terephthalate) support:

(1) a subbing layer of a titanium alkoxide (duPont Tyzor TBT®) (0.081 g/m²) from a n-propyl acetate and n-butyl alcohol solvent mixture, and (2) a dye layer containing the cyan dye illustrated above (0.28 g/m²), and duPont DLX-6000 Teflon® micropowder (0.016 g/m²) in a cellulose acetate propionate binder (2.5% acetyl, 45% propionyl) (0.44 g/m²) coated from a toluene, methanol and cyclopentanone solvent mixture.

On the back side of the dye-donor was coated:

(1) a subbing layer of Bostik 7650® polyester (Emhart Corp.) (0.11 g/m²) coated from a toluene, 3-pentanone and 2-butanone solvent mixture, and (2) a slipping layer of the silicone identified below in the amounts shown in Table 3 in a cellulose acetate propionate binder (2.5% acetyl, 45% propionyl) (0.54 g/m²) coated from a toluene and 3-pentanone solvent mixture. Controls 10 and 11 had no binder as is described in JP 61/227087. Polymers with free terminal amine groups were neutralized with p-toluene sulfonic acid before coating.

Three commercial aminopropyl dimethyl-terminated polydimethyl siloxanes were involved in these experiments:

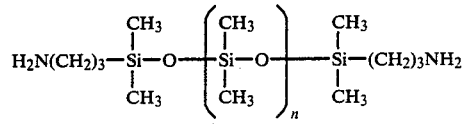

Invention 1

See Example 1.

Invention 3

Available commercially from Petrarch Systems, Inc.: PS-510® (viscosity: 50 ctsk, ~3000 mw).

Invention 4

General Electric 218-1036® (viscosity: 190 ctsk., ~6800 mw). Intermediate for Control 8).

Dye-receivers were prepared as described in Example 1. The same evaluation procedure was used as in Example 1 with the following results:

TABLE 3

| Silicone ($g/m^2$) | Relative Force (lbs) Step 2 (D~0.3) |
|---|---|
| Invention 4 (0.016) | 1.1 |
| Invention 3 (0.011) | 1.5 |
| Invention 1 (0.016) | 0.8 |
| Comparison (binder only) | 3.7 |
| Control 8 (0.017) | 4.6 |
| Control 10* (0.70) | 2.2 |
| Control 9 (0.018) | 4.9 |
| Control 11** (0.70) | 2.9 |

*Same as Control 8 except no binder
**Same as Control 9 except no binder

The above results indicate that the polysiloxane slipping layers of the invention with free amino terminal groups perform far better than the prior art polymers which have their free amino function blocked during synthesis of the polyurethane, polyamide, or polyester derivative polymer.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side a slipping layer comprising a lubricating material dispersed in a polymeric binder, the improvement wherein said lubricating material comprises a linear or branched aminoalkyl-terminated poly(dialkyl, diaryl or alkylaryl siloxane).

2. The element of claim 1 wherein said polysiloxane is present in an amount of from about 0.0005 to about 0.05 $g/m^2$, representing approximately 0.1 to 20% of the binder weight, and the polymeric binder is a thermoplastic binder.

3. The element of claim 2 wherein said thermoplastic binder is a styrene-acrylonitrile copolymer.

4. The element of claim 1 wherein said siloxane is an aminopropyldimethyl-terminated polydimethylsiloxane.

5. The element of claim 4 wherein said polysiloxane has the formula:

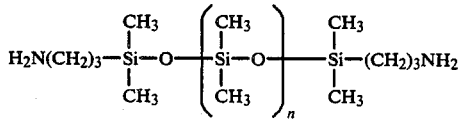

wherein n is from about 10 to about 2000.

6. The element of claim 1 wherein said siloxane polymer is a T-structure polydimethylsiloxane with an aminoalkyl functionality at the branchpoint.

7. The element of claim 6 wherein said siloxane polymer has the formula:

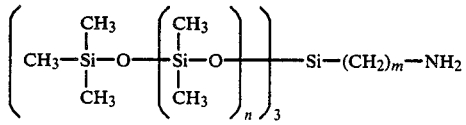

wherein m is from about 1 to about 10 and n is from about 10 to about 1000.

8. The element of claim 1 wherein said support comprises poly(ethylene terephthalate).

9. The element of claim 8 wherein said dye layer comprises sequential repeating areas of cyan, magenta and yellow dye.

10. In a process of forming a dye transfer image comprising (a) imagewise-heating a dye-donor element comprising a support having on one side thereof a dye layer and on the other side a slipping layer comprising a lubricating material dispersed in a polymeric binder, and (b) transferring a dye image to a dye-receiving element to form said dye transfer image, the improvement wherein said lubricating material comprises a linear or branched aminoalkyl-terminated poly(dialkyl, diaryl or alkylaryl siloxane).

11. The process of claim 10 wherein said polysiloxane is present in an amount of from about 0.0005 to about 0.05 $g/m^2$, representing approximately 0.1 to 10% of the binder weight, and the polymeric binder is a thermoplastic binder.

12. The process of claim 10 wherein said siloxane is an aminopropyldimethyl-terminated polydimethylsiloxane.

13. The process of claim 10 wherein said siloxane polymer is a T-structure polydimethylsiloxane with an aminoalkyl functionality at the branchpoint.

14. The process of claim 10 wherein said support is poly(ethylene terephthalate) which is coated with sequential repeating areas of cyan, magenta and yellow dye, and said process steps are sequentially performed for each color to obtain a three-color dye transfer image.

15. In a thermal dye transfer assemblage comprising:

(a) a dye-donor element comprising a support having on one side thereof a dye layer and on the other side a slipping layer comprising a lubricating material dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said lubricating material comprises a linear or branched aminoalkyl-terminated poly(dialkyl, diaryl or alkylaryl siloxane).

16. The assemblage of claim 15 wherein said polysiloxane is present in an amount of from about 0.0005 to about 0.05 $g/m^2$, representing approximately 0.1 to 10% of the binder weight, and the polymeric binder is a thermoplastic binder.

17. The assemblage of claim 16 wherein said thermoplastic binder is a styrene-acrylonitrile copolymer.

18. The assemblage of claim 15 wherein said siloxane is an aminopropyldimethyl-terminated polydimethylsiloxane.

19. The assemblage of claim 15 wherein said siloxane polymer is a T-structure polydimethylsiloxane with an aminoalkyl functionality at the branchpoint.

20. The assemblage of claim 15 wherein said support of the dye-donor element comprises poly(ethylene terephthalate) and said dye layer comprises sequential repeating areas of cyan, magenta and yellow dye.

* * * * *